US010441510B2

(12) United States Patent
Omura

(10) Patent No.: US 10,441,510 B2
(45) Date of Patent: Oct. 15, 2019

(54) TABLET CASSETTE

(71) Applicant: TOSHO, INC., Tokyo (JP)

(72) Inventor: Yoshihito Omura, Tokyo (JP)

(73) Assignee: TOSHO, INC., Tokyo (JP)

( * ) Notice: Subject to any disclaimer, the term of this patent is extended or adjusted under 35 U.S.C. 154(b) by 0 days.

(21) Appl. No.: 16/071,655

(22) PCT Filed: Jan. 20, 2017

(86) PCT No.: PCT/JP2017/001960
§ 371 (c)(1),
(2) Date: Jul. 20, 2018

(87) PCT Pub. No.: WO2017/126670
PCT Pub. Date: Jul. 27, 2017

(65) Prior Publication Data

US 2019/0021955 A1 Jan. 24, 2019

(30) Foreign Application Priority Data

Jan. 21, 2016 (JP) ..... 2016-009939

(51) Int. Cl.
*A61J 7/00* (2006.01)
*A61J 3/00* (2006.01)
(Continued)

(52) U.S. Cl.
CPC ..... *A61J 7/0076* (2013.01); *A61J 3/00* (2013.01); *A61J 7/0007* (2013.01); *G07F 11/24* (2013.01); *G07F 17/0092* (2013.01)

(58) Field of Classification Search
CPC ..... G07F 17/0092; G07F 11/62; G07F 9/026; G07F 11/44; G06F 19/3462
See application file for complete search history.

(56) References Cited

U.S. PATENT DOCUMENTS 6,073,799 A * 6/2000 Yuyama ..... B65B 1/30 221/154
6,170,229 B1 * 1/2001 Kim ..... B65B 35/56 221/265

(Continued)

FOREIGN PATENT DOCUMENTS

JP 2002-279068 9/2002
JP 2012-120719 6/2012

(Continued)

OTHER PUBLICATIONS

International Search Report, dated Apr. 4, 2017 (dated Apr. 4, 2017), 3 pages.

*Primary Examiner* — Jacob S. Scott
*Assistant Examiner* — Ayodeji T Ojofeitimi
(74) *Attorney, Agent, or Firm* — Rankin, Hill & Clark LLP

(57) ABSTRACT

A tablet cassette includes: support points to support a swing member in a slit formed in a bottomed hole of a hollow rotary shaft; an engaged portion provided on a bottom wall portion of a container and spaced from the hollow rotary shaft to surround the rotary shaft; a swing member having a follower portion and an engaging portion located on different sides of the support points; and an urging member operable to move the engaging portion toward the engaged portion and move the follower portion into the bottomed hole. In a free state wherein the tablet cassette is detached from the base, the engaging portion engages with the engaged portion. When the tablet cassette is mounted to the base and the drive shaft is fitted into the bottomed hole, the follower portion is pushed out of the bottomed hole, and the engaging portion is disengaged from the engaged portion.

10 Claims, 11 Drawing Sheets

(51) Int. Cl.
*G07F 11/24* (2006.01)
*G07F 17/00* (2006.01)

(56) References Cited

U.S. PATENT DOCUMENTS 6,256,963 B1 * 7/2001 Kim ..... B65B 5/103 221/265
6,405,893 B1 * 6/2002 Tobe ..... G07F 9/02 221/2
6,471,090 B1 * 10/2002 Inamura ..... G07F 11/44 221/124
7,040,505 B2 * 5/2006 Hashimoto ..... B65B 5/103 221/203
7,395,946 B2 * 7/2008 Yuyama ..... G07F 11/44 221/186
7,861,492 B2 * 1/2011 Yuyama ..... B65B 5/103 221/2
2005/0182512 A1 * 8/2005 Takeda ..... B65B 35/10 700/231
2010/0078445 A1 * 4/2010 Nam ..... B65B 35/08 221/154
2011/0309101 A1 * 12/2011 Kokie ..... A61J 7/0007 221/30
2013/0240555 A1 * 9/2013 Kim ..... B65B 5/103 221/1
2013/0267927 A1 10/2013 Omura et al.
2014/0203034 A1 7/2014 Bae et al.
2015/0197391 A1 * 7/2015 Yuyama ..... B65D 83/04 221/2
2016/0001956 A1 1/2016 Schmidt-Ellinger et al.
2016/0213571 A1 7/2016 Takahama et al.
2016/0220448 A1 * 8/2016 Takahama ..... A61J 7/0076
2018/0079540 A1 * 3/2018 Schmidt-Ellinger ... B65B 35/08

FOREIGN PATENT DOCUMENTS

JP 2012-179127 9/2012
JP 2014-140615 8/2014
WO 2015/041230 3/2015

* cited by examiner

16'A
16'B
16'C
16'B
16'
16'B
16'C
16'C
16'B
16'C
16'B
16'C
16'B

TABLET CASSETTE

TECHNICAL FIELD

The present invention relates to a tablet cassette that contributes to automated supply of tablets in dispensing medicine in hospitals, pharmacies, and so forth.

BACKGROUND ART

A conventional tablet feeder will be described below with reference to the drawings. The tablet feeder includes a tablet cassette and a base serving as a drive portion that removably supports the cassette. FIG. 9A is a perspective view illustrating that a tablet cassette 10 is detached from a base 20. FIG. 9B is a perspective view illustrating that the tablet cassette 10 is mounted to the base 20. FIG. 10A is a vertical sectional perspective view illustrating the inside of the tablet cassette 10. FIG. 10B is a vertical sectional perspective view illustrating the tablet cassette 10 and the base 20, whereby the tablet cassette 10 is mounted on the tablet base 20 from above and the base 20 supports the tablet cassette 10 from below. FIG. 11A is a vertical sectional perspective view of a rotor 16. FIG. 11B is a perspective view of the rotor 16 and a motor portion 21 in the course of being coupled to each other.

The tablet cassette 10 (see FIGS. 9 and 10) includes a tablet container 10A. The tablet container 10A includes: a fitting frame 11 that allows horizontal positioning and attitude stabilization of the tablet cassette 10 when the tablet cassette 10 is mounted to the base 20 (support portion); a bottom wall portion 12 that allows vertical positioning and attitude stabilization of the tablet cassette 10 when the tablet cassette 10 is mounted to the base 20; a lower portion 13 that constitutes a part of a medicine containing space S for containing tablets and that is provided with a partition plate and a discharge port H to allow tablets to sequentially fall down; an upper portion 14 that also constitutes a part of the medicine containing space S for containing tablets to expand the medicine containing space to a space above the lower portion 13; and a lid 15 that opens and closes when tablets are replenished, etc. The tablet cassette 10 also includes the rotor 16 stored in the lower portion 13 so as to be rotatable about an axis. The rotor 16 includes a rotary body 16A, and a hollow rotary shaft 17 (follower shaft) that extends vertically downward from the position of the axis of the rotary body 16A, either directly (see Patent Documents 1 to 3, for example) or indirectly via a gear or the like (see Patent Document 4, for example), to project from the bottom surface of the lower portion 13. In other words, the rotor 16 includes the hollow rotary shaft 17 having an axial line extending in a direction orthogonal to the bottom wall portion 12 and having an opening portion on an opposite side to the tablet containing space S, and the rotary body 16A. The rotary body 16A is configured to rotate about the axial line together with the hollow rotary shaft 17 in the tablet containing space S of the tablet container 10A. The rotary body 16A is unitarily provided with a plurality of blades 16C for forming a plurality of tablet receiving portions 16B in a peripheral portion of the rotary body 16A at predetermined intervals in the circumferential direction to receive the tablets (not illustrated) one by one and to allow the tablets to pass therethrough to the discharge port H (see Patent Document 1 etc., for example).

The base 20 (see FIGS. 9 and 10) is fixed in an array to a shelf or the like of a storage of a tablet dispensing apparatus (see Patent Document 1, for example), or fixed to a top plate portion of a tablet splitting apparatus (see Patent Document 2, for example), and is configured to receive power supply and control required for operation from an object to which the base 20 is mounted. The base 20 includes the motor portion 21 (drive portion), a support portion 22 (seat portion), and a fitting portion 23 (seat portion). The motor portion 21 includes a drive shaft 24 having an outer tooth portion 25 at the upper end portion thereof to rotate the drive shaft 24 about an axis according to the control. The support portion 22 is shaped in a generally transverse plate, holds the motor portion 21 and is fixed to an object to which the base 20 is mounted. The fitting portion 23 is formed at the upper portion of the side peripheral surfaces of the support portion 22 to be fitted into the fitting frame 11. When the tablet cassette 10 is mounted on top of the base 20 (see FIG. 9B), the base 20 supports the tablet cassette 10 from below, and transfers a rotational force of the motor portion 21 to the tablet cassette 10.

A rotation transfer mechanism (see FIG. 10) between the tablet cassette 10 and the base 20 includes the hollow rotary shaft 17 which is a part (containing portion-side transfer mechanism) of the tablet cassette 10, and the drive shaft 24 which is a part (drive portion-side transfer mechanism) of the base 20. The hollow rotary shaft 17 is formed with a bottomed hole 17*a* that opens at the lower end. An inner tooth portion 18 is formed at the lower portion of the bottomed hole 17*a*. A first tapered surface 19 is formed at the lower-end opening portion of the inner tooth portion 18. Correspondingly, the outer tooth portion 25 is formed at the upper portion of the drive shaft 24 of the motor portion 21. A second tapered surface 26 is formed at the upper end portion of the outer tooth portion 25. When the tablet cassette 10 is moved downward onto the base 20 from above (see FIG. 9B), the fitting frame 11 and the fitting portion 23 are fitted with each other (see FIG. 10B), and the hollow rotary shaft 17 and the drive shaft 24 are fitted with each other (see FIG. 11B). In this event, initially, the first tapered surface 19 of the hollow rotary shaft 17 and the second tapered surface 26 of the drive shaft 24 are freely fitted with each other. Then, the inner tooth portion 18 of the hollow rotary shaft 17 and the outer tooth portion 25 of the drive shaft 24 are meshed with each other (see Patent Documents 1 to 3, for example).

RELATED-ART DOCUMENT

Patent Document

Patent Document 1: JP 2002-279068 A
Patent Document 2: JP 2012-179127 A
Patent Document 3: JP 2012-120719 A

SUMMARY OF INVENTION

Technical Problem

In the above-mentioned tablet cassette 10, the transfer mechanism which is constituted together with the base 20 having the drive portion is a rotation transfer mechanism of a so-called axial fitting type as discussed above. Thus, if there is displacement in tooth position between the inner tooth portion 18 and the outer tooth portion 25 after attachment of the tablet cassette 10 to the base 20, at the time of replacement with another cassette, or the like, the hollow rotary shaft 17 (the rotary body 16A of the rotor 16) may be rotated because of such displacement when the cassette is mounted, which may cause undesirable discharge operation beyond control. Thus, there is devised not only a scheme of suppressing or mitigating the effect of the displacement discussed above, but also a scheme of inhibiting shaft rotation beyond control when the shafts are fitted or meshed with each other, in order to take necessary measures (see Patent Document 3, for example).

However, such measures mainly address mounting of the cassette when undesirable discharge of tablets tends to occur, and involve modifications to both the rotary shaft (follower portion) of the tablet cassette 10 and the drive shaft 24 of the base 20. Therefore, the tablet cassette 10, to which the measures have been applied, can only be used for dispensing apparatuses etc. provided with the base 20, to which the corresponding measures have been applied. Thus it is not easy to apply such measures to the existing dispensing apparatuses etc. When handling the tablet cassette 10 detached from the base 20, in addition, care must be taken such that the hollow rotary shaft 17 and the rotor 16 which are not locked will not be rotated when carrying along the tablet cassette 10, replenishing the tablet cassette 10 with tablets, etc.

Thus, there is a technical challenge in achieving a tablet cassette configured to inhibit rotation of a rotary shaft of an axial fitting type independently when the tablet cassette is not mounted to a base.

An object of the present invention is to provide a tablet cassette capable of inhibiting rotation of a hollow rotary shaft when the tablet cassette is not mounted to a base.

Solution to Problem

A tablet cassette of the present invention includes a tablet container, a rotor, and a lock mechanism. The tablet container has a tablet containing space therein for containing a plurality of tablets in a random manner, and includes a bottom wall portion formed with a discharge port to allow the plurality of tablets in the tablet containing space to fall down one by one. The rotor includes a hollow rotary shaft and a rotary body. The hollow rotary shaft has an axial line extending in a direction orthogonal to the bottom wall portion, and has an opening portion on an opposite side to the tablet containing space. The rotary body is configured to rotate about the axial line together with the hollow rotary shaft in the tablet containing space of the tablet container, and has a plurality of tablet receiving portions provided in a peripheral portion of the rotary body at predetermined intervals in a circumferential direction to receive the tablets one by one and to allow the tablets to pass therethrough to the discharge port. The rotor is rotated when a motor is rotated with a drive shaft operable to be rotated by the motor being fitted with the hollow rotary shaft. The lock mechanism is configured to inhibit rotation of the hollow rotary shaft when the hollow rotary shaft is pulled off from the drive shaft, and to allow the hollow rotary shaft to rotate together with the drive shaft when the hollow rotary shaft is fitted with the drive shaft.

When the lock mechanism is provided as in the present invention in a state that the tablet cassette is not mounted to the base, namely, is freed from the base, movement of the hollow rotary shaft is inhibited, and rotation of the rotor with respect to the tablet containing space is accordingly stopped. Thus, rotation of the hollow rotary shaft and the rotary body is inhibited independently. When the tablet cassette is mounted to the base, the drive shaft is fitted into the hollow rotary shaft, and the hollow rotary shaft (or the rotor) can make axial rotation to allow the tablets to be sequentially discharged from the tablet containing space. As a result, the inherent function required for the tablet cassette is maintained.

The lock mechanism may be configured to include a slit, a swing member, an engaged portion, and an urging member, for example. The slit is formed in the hollow rotary shaft to penetrate the hollow rotary shaft in a radial direction, and extends in an axial direction. The swing member is supported with respect to the hollow rotary shaft so as to be swingable about a support point of swing motion provided in the slit. The swing member includes a follower portion located in an internal space of the hollow rotary shaft, and an engaging portion located outside the hollow rotary shaft. The engaged portion is provided on the bottom wall portion of the tablet container, and spaced from the hollow rotary shaft to surround the hollow rotary shaft. The urging member is operable to urge the swing member such that the engaging portion is moved toward the engaged portion and the follower portion is moved into the hollow rotary shaft. In this case, the swing member is swung in one direction by an urging force of the urging member to cause the engaging portion to engage with the engaged portion when the hollow rotary shaft is pulled off from the drive shaft. When the hollow rotary shaft is fitted with the drive shaft, the follower portion is pushed by the drive shaft radially outward to cause the swing member to swing in the other direction, thereby cancelling engagement between the engaging portion and the engaged portion.

With the tablet cassette according to the present invention, in a state that the tablet cassette is not mounted to the base, namely, is freed from the base, the engaging portion of the swing member is urged by the urging member to abut against and engage with the engaged portion. Thus, movement of the swing member and hence the hollow rotary shaft with respect to the engaged portion is inhibited. As a result, rotation of the rotor with respect to the tablet containing space is stopped. Thus, rotation of the hollow rotary shaft (or the rotor) is accordingly inhibited independently. When the tablet cassette is mounted to the base, the drive shaft on the base side is fitted into the hollow rotary shaft. In this event, the follower portion of the swing member is pushed out of the slit by the drive shaft. Thus, the swing member is swung against the urging force, and the engaging portion of the swing member is accordingly disengaged from the engaged portion. As a result, in a state that the base is mounted to the cassette, the hollow rotary shaft (or the rotor) can make axial rotation to allow the tablets to be sequentially discharged from the tablet containing space.

Moreover, the hollow rotary shaft is formed with the slit, the support points of swing motion and the middle portion of the swing member are disposed in the slit, and the engaged portion is provided on the bottom wall portion of the tablet containing space to surround the hollow rotary shaft. Consequently, the lock mechanism including the engaged portion and the swing member can be made compact. Thus, according to the present invention, it is possible to achieve a compact tablet cassette configured to inhibit rotation of the hollow rotary shaft of an axial fitting type independently when the tablet cassette is not mounted to the base.

Another lock mechanism includes a slit, a linear moving member, an engaged portion, and an urging member. The slit is formed in the hollow rotary shaft to penetrate the hollow rotary shaft in a radial direction, and extends in an axial direction. The linear moving member is provided in the slit so as to be linearly movable in the slit. The linear moving member includes a follower portion located in an internal space of the hollow rotary shaft, and an engaging portion located outside the hollow rotary shaft. The engaged portion is provided on the bottom wall portion of the tablet container, and spaced from the hollow rotary shaft to surround the hollow rotary shaft. The urging member is operable to urge the linear moving member such that the engaging portion is moved toward the engaged portion and the follower portion is linearly moved toward the bottom wall portion. In this case, the linear moving member is moved toward the bottom wall portion by an urging force of the urging member to cause the engaging portion to engage with the engaged portion when the hollow rotary shaft is pulled off from the drive shaft. When the hollow rotary shaft is fitted with the drive shaft, the follower portion is pushed by the drive shaft to cause the linear moving member to move in the slit away from the bottom wall portion, thereby cancelling engagement between the engaging portion and the engaged portion. Also with this structure, it is possible to achieve a compact tablet cassette configured to inhibit rotation of the hollow rotary shaft of an axial fitting type independently when the tablet cassette is not mounted to the base.

The engagement between the engaging portion and the engaged portion may be achieved by fitting between at least one projection and at least one recess. Here, preferably, the engaged portion includes a plurality of recesses provided at predetermined intervals in the circumferential direction when the engaging portion includes the at least one projection, and the engaged portion includes a plurality of projections provided at predetermined intervals in the circumferential direction when the engaging portion includes the at least one recess. The engagement can be maintained by achieving engagement between the engaging portion and the engaged portion through fitting between the projection and the recess.

Preferably, the engaged portion has an annular wall surface that extends along the hollow rotary shaft; the annular wall surface is formed with the plurality of recesses or the plurality of projections that extend along the hollow rotary shaft; and the engaging portion is formed with the at least one projection or the at least one recess so as not to inhibit swing motion of the swing member.

Preferably, a plurality of grooves that extend in the axial direction are formed at constant intervals in the circumferential direction in a portion of an inner peripheral portion of the hollow rotary shaft excluding a portion in which the slit is formed; and a plurality of protrusions that extend in the axial direction are provided at constant intervals in the circumferential direction on an outer peripheral portion of the drive shaft to be fitted in the plurality of grooves.

Preferably, a portion of the rotary body that faces the bottom wall portion is formed with an annular recessed portion that opens toward the bottom wall portion and that surrounds the hollow rotary shaft; and the annular recessed portion receives a part or entirety of the engaged portion and a part or entirety of the engaging portion. With such a configuration, even if the desired lock mechanism includes the engaged portion and the engaging portion, the tablet containing space in the tablet container is not occupied significantly by the engaged portion and the engaging portion since a large part of the engaged portion and the engaging portion is received in the annular recessed portion of the rotary body. Moreover, the lock mechanism can be built in the cassette without increasing the size of the other members. Thus, the entire cassette can be made compact.

The urging member is preferably received in the internal space of the hollow rotary shaft. With such a structure, the drive shaft and the hollow rotary shaft can be reliably coupled to each other. With the urging member received inside the hollow rotary shaft, a space for the urging member is not required, and the size of the other members is not increased. Thus, the entire cassette can be made compact.

When the first tapered surface is formed at an inner circumferential portion of the opening portion of the hollow rotary shaft and the second tapered surface is formed at an outer circumferential portion at a distal end of the drive shaft, the dimensions are determined as follows. That is, a distance between a start position of following motion, at which the follower portion starts following motion, in the internal space of the hollow rotary shaft and the opening portion of the hollow rotary shaft is larger than a sum of an axial length of the first tapered surface of the hollow rotary shaft and an axial length of the second tapered surface of the drive shaft. If one or both of the opening portion of the hollow rotary shaft and the distal end portion of the drive shaft of the base to which the tablet cassette is mounted are chamfered, the hollow rotary shaft and the drive shaft can be smoothly fitted with each other. The transfer of rotary motion from the rotary shaft to the hollow rotary shaft can be established only when the hollow rotary shaft and the drive shaft are fitted with each other deeply over a length more than the sum of the axial length of the first tapered surface of the hollow rotary shaft and the axial length of the second tapered surface at the distal end of the drive shaft.

Under such preconditions, further requirements for the state of supporting the swing member by the hollow rotary shaft are imposed on the tablet cassette according to the present invention. That is, the distance between the start position of following motion, at which the follower portion of the swing member starts following motion in the hollow rotary shaft and the opening portion of the hollow rotary shaft is larger than the sum described above. To be exact, the distance between the start position of following motion, which is the position of a portion of the follower portion of the swing member to be first contacted by the drive shaft fitted into the hollow rotary shaft, and the opening end of the hollow rotary shaft is larger than the above-mentioned sum. Therefore, when the hollow rotary shaft and the drive shaft are fitted with each other, the first tapered surface and the second tapered surface start being fitted with each other smoothly, but in such a manner that rotation is not fully transferred. Next, the hollow rotary shaft and the drive shaft are fitted deeply with each other after fitting of the first tapered surface and the second tapered surface, at the point of which rotation transfer between the hollow rotary shaft and the drive shaft is established. After that, the drive shaft and the swing member abut against each other. Consequently, engagement between the swing member and the engaged portion is cancelled after the rotation transfer is established. As a result, even if there is displacement in tooth position etc. between the hollow rotary shaft and the drive shaft, priority is given to rotation and fixation of the hollow rotary shaft, followed by rotation of the drive shaft, thereby establishing the rotation transfer and furthermore adequately preventing undesirable discharge of the tablets beyond control when mounting the cassette.

BRIEF DESCRIPTION OF DRAWINGS

FIG. 3C is a vertical sectional perspective view illustrating that the drive shaft of the motor portion is engaged with the hollow rotary shaft of the rotor.

DESCRIPTION OF EMBODIMENTS

A tablet cassette according to a plurality of embodiments of the present invention will be described below with reference to the drawings.

Figure 2A:
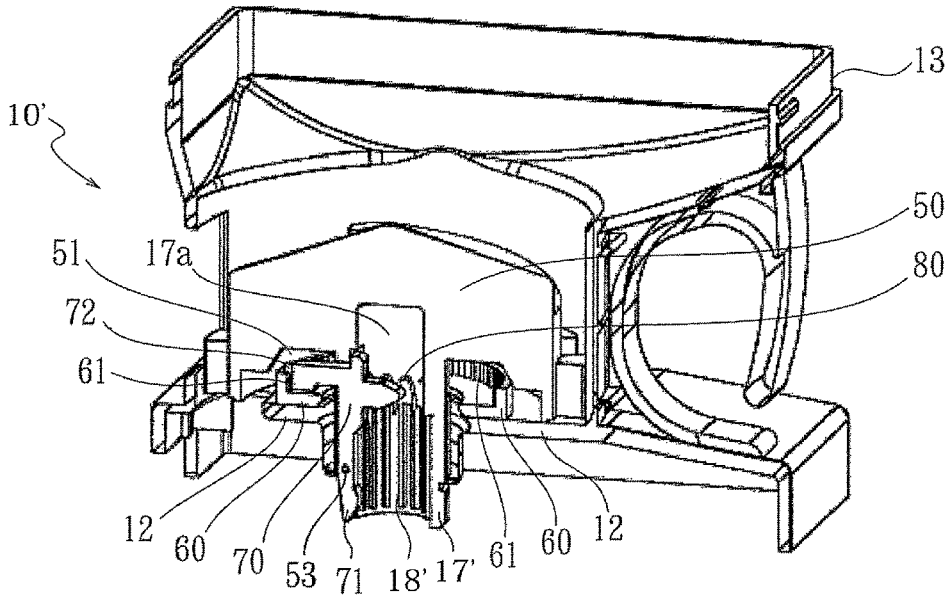
FIG. 2A is a vertical sectional perspective view of the tablet cassette in the free state with a lid and an upper portion of a container being removed therefrom.
Figure 2B:
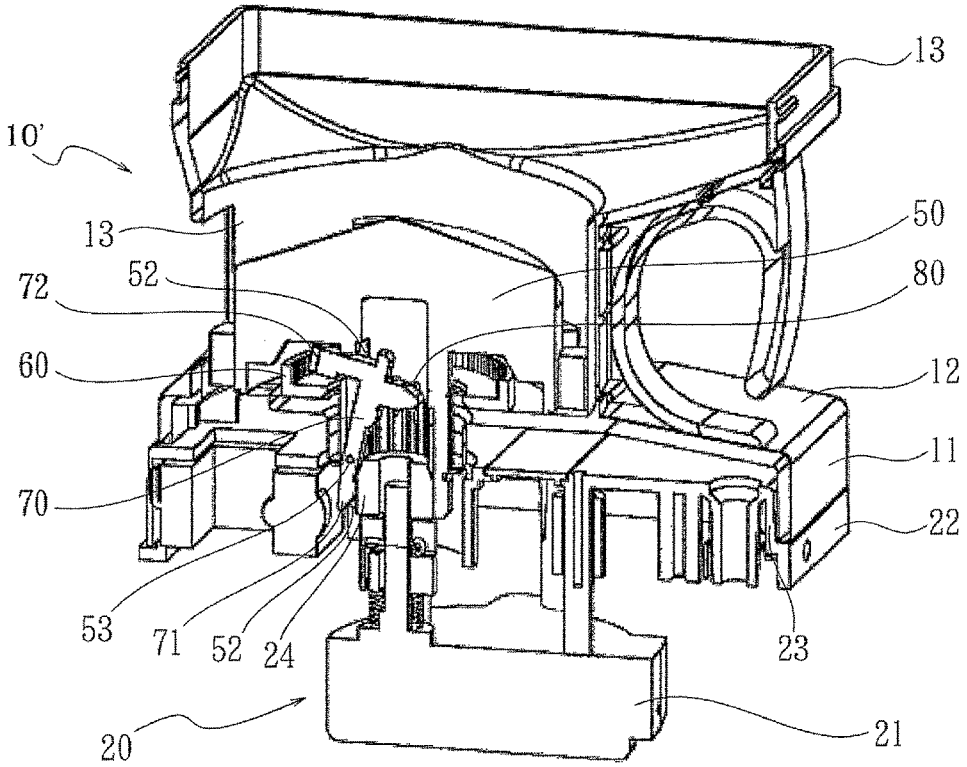
FIG. 2B is a vertical sectional perspective view of the tablet cassette mounted to the base.
Figure 3A:
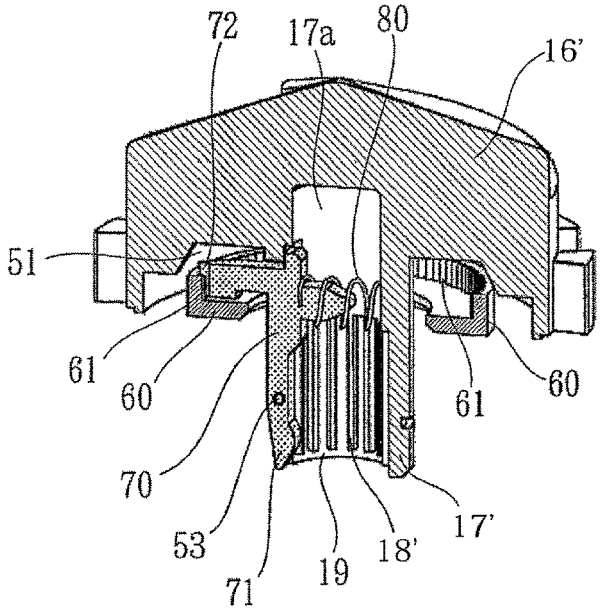
FIG. 3A is a vertical sectional perspective view of a rotor and a lock mechanism.
Figure 3B:
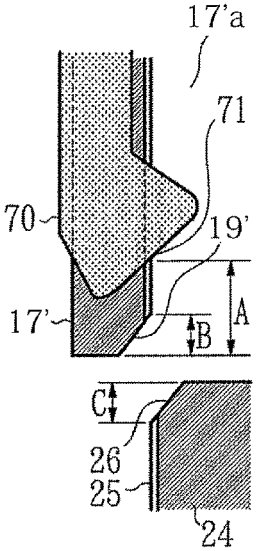
FIG. 3B is an enlarged sectional view of chamfered portions of a hollow rotary shaft of the rotor and a drive shaft of a motor portion.
Figure 3B:
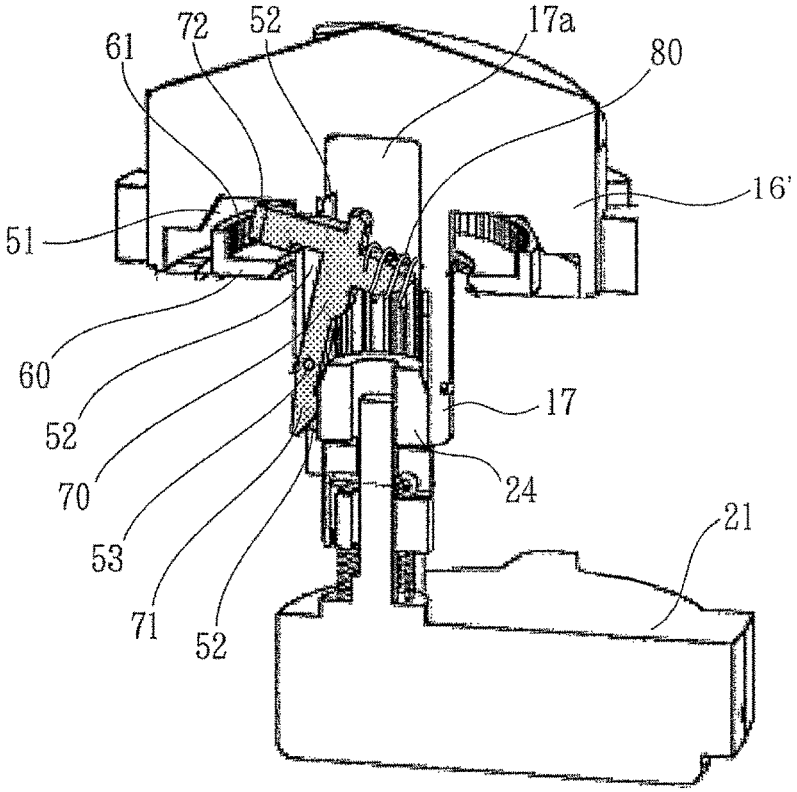
Figure 9A:
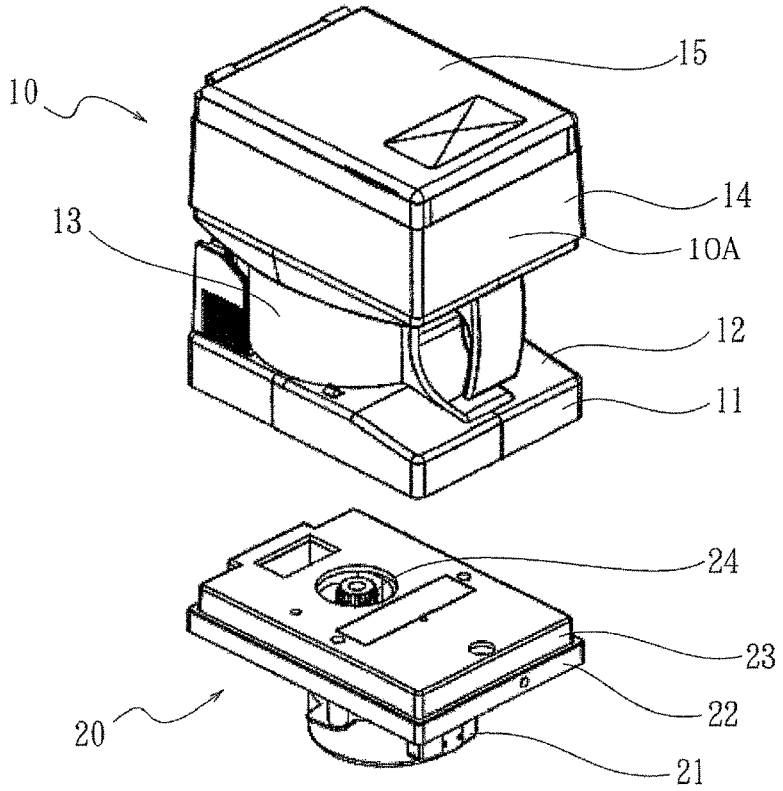
FIG. 9A is a perspective view illustrating that the cassette is detached from the base.
Figure 9B:
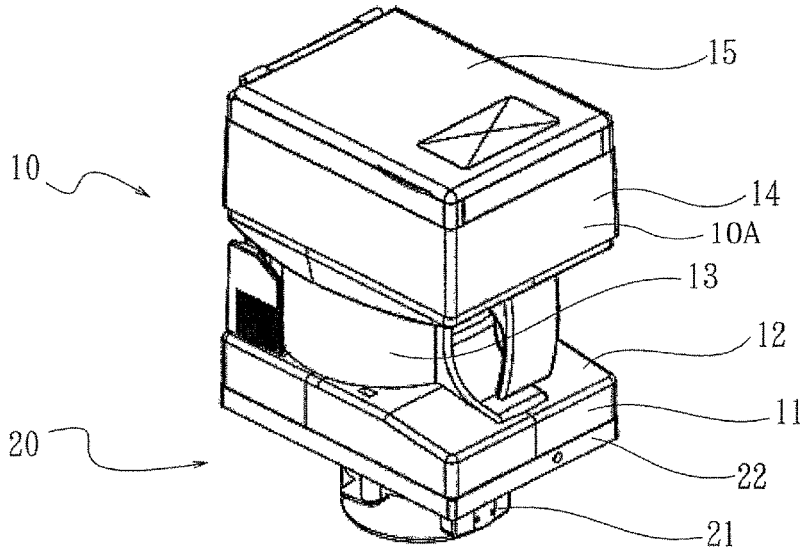
FIG. 9B is a perspective view illustrating that the cassette is mount to the base.
Figure 10A:
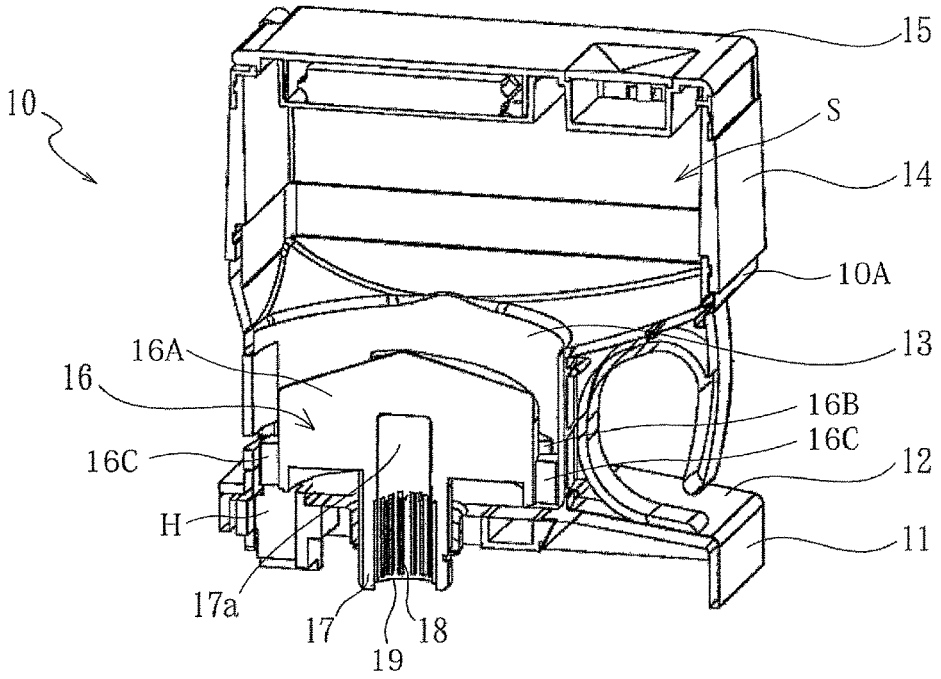
FIG. 10A is a vertical sectional perspective view of a tablet cassette.
Figure 10B:
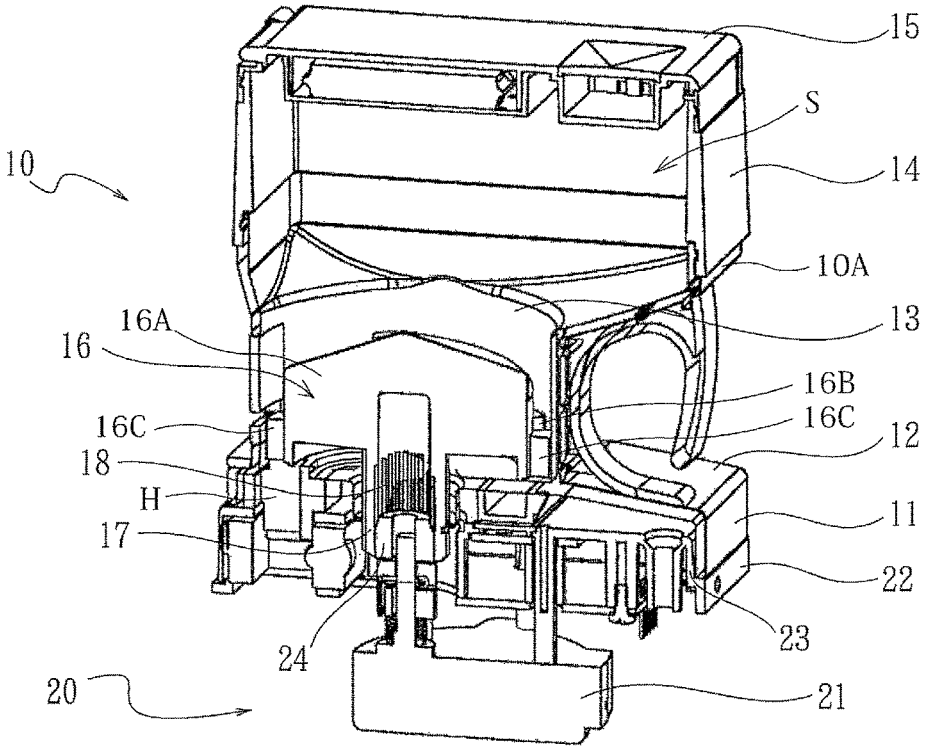
FIG. 10B is a vertical sectional perspective view of the tablet cassette mounted to the base.
Figure 11A:
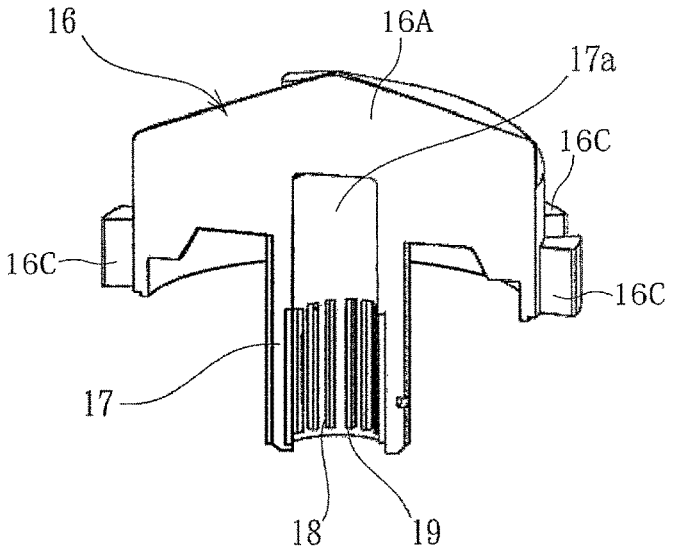
FIG. 11A is a vertical sectional perspective view of a rotor.
Figure 11B:
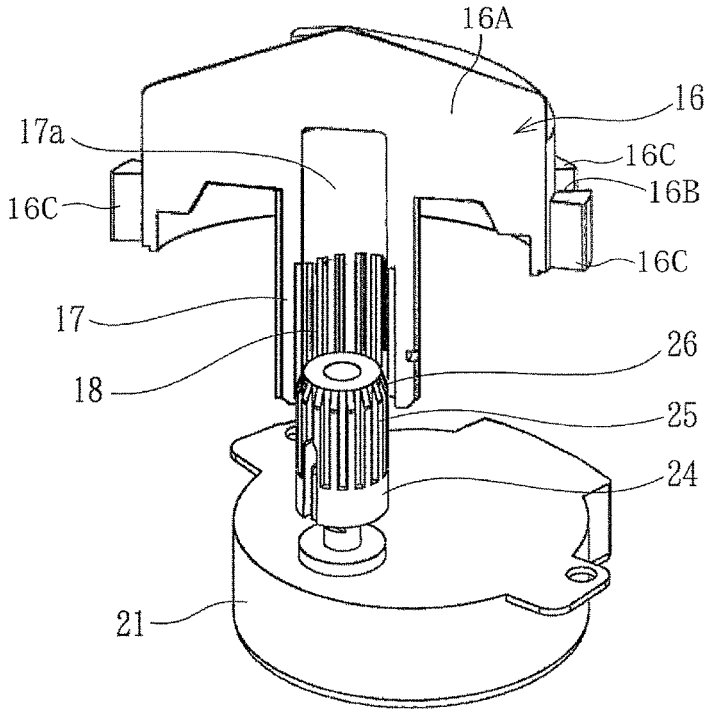
FIG. 11B is a perspective view illustrating that a motor portion is engaged with the rotor.

In FIGS. 1 to 3, constituent elements that are similar to those according to the related art illustrated in FIGS. 9 to 11 are given the same reference numerals, and elements with a different configuration are given reference numerals obtained by adding a dash to the reference numerals indicated in FIGS. 9 to 11. Differences from the related art will be mainly described in detail below.

First Embodiment

Figure 1A:
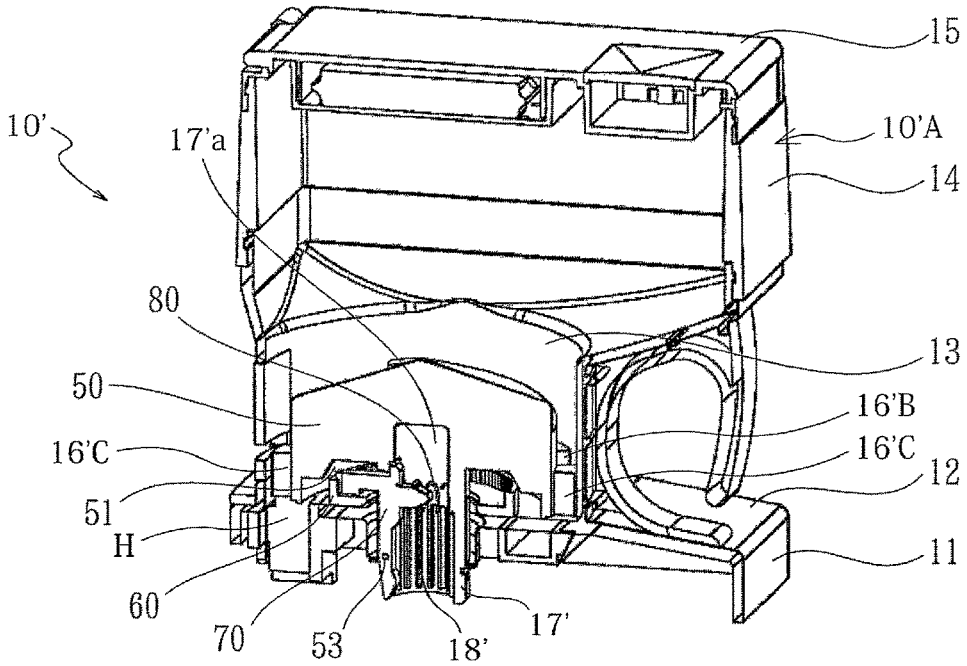
FIG. 1A is a vertical sectional perspective view of a tablet cassette in a free state.
Figure 1B:
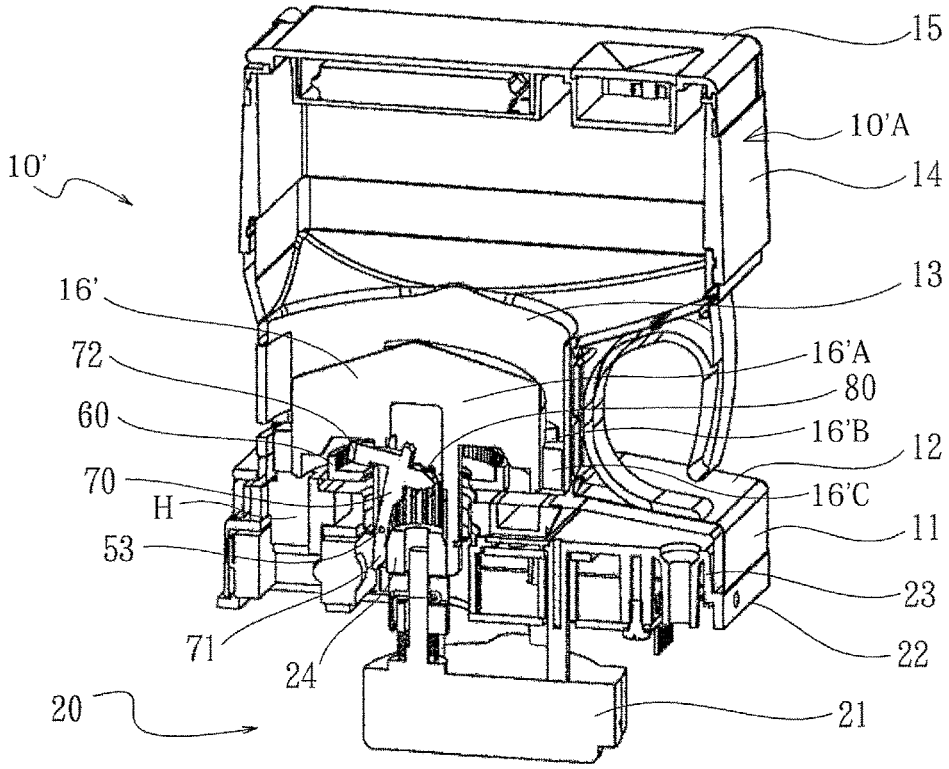
FIG. 1B is a vertical sectional perspective view of a base and the tablet cassette mounted thereto.

A specific configuration of a tablet cassette according to a first embodiment of the present invention will be described with reference to the drawings. FIG. 1A is a vertical sectional perspective view illustrating the inside of a tablet cassette 10' in a free state. FIG. 1B is a vertical sectional perspective view illustrating the tablet cassette 10' and a base 20, whereby the cassette 10' is mounted on the base 20 from above and the base 20 supports the cassette 10' from below. FIG. 2A is a vertical sectional perspective view illustrating the inside of the tablet cassette 10' in the free state with a lid 15 and an upper portion 14 being detached from the tablet cassette 10'. FIG. 2B is a vertical sectional perspective view of the tablet cassette 10' and the base 20, whereby the cassette 10' is mounted on the base 20 from above and the base 20 supports the tablet cassette 10' from below.

Figure 4:
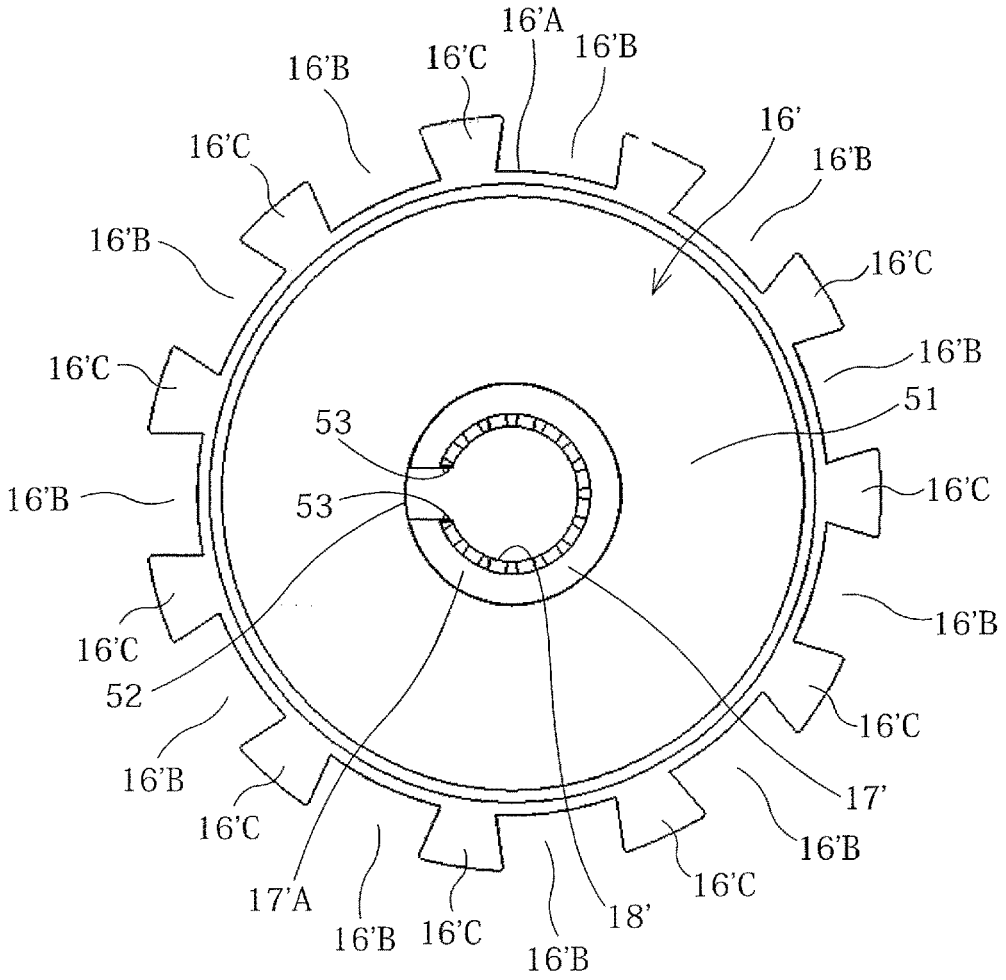
FIG. 4 is a bottom view of the rotor.

FIG. 3A is a vertical sectional perspective view of a rotor 16' and lock mechanisms 60 to 80. FIG. 3B is a sectional enlarged view of a first tapered surface 19' of an inner tooth portion 18' of a hollow rotary shaft 17' of the rotor 16', a second tapered portion 26 of an outer tooth portion 25 of a drive shaft 24 of a motor portion 21, and a follower portion 71 of a swing member 70. FIG. 3C is a vertical sectional perspective view illustrating that the outer tooth portion 25 of the drive shaft 24 of the motor portion 21 is engaged with the inner tooth portion 18' of the hollow rotary shaft 17' of the rotor 16'. In FIGS. 3A and 3C, for clear illustration of an urging member 80, the urging member 80 is not illustrated in section, but a portion of the urging member 80 on the closer side with respect to the swing member 70 is also illustrated. FIG. 4 is a bottom view of the rotor 16' as seen from the side of an opening portion of the hollow rotary shaft 17'. The appearance of the tablet cassette 10' is the same as the appearance of the tablet cassette 10 illustrated in FIGS. 9 to 11 and discussed already.

The tablet cassette 10' (see FIGS. 1 to 3) includes a fitting frame 11, a bottom wall portion 12, a lower portion 13 of a container, the upper portion 14 of the container, and the lid 15, as with the tablet cassette 10 according to the related art, and also includes the rotor 16' with a new structure obtained by modifying the rotor 16 of the tablet cassette 10 according to the related art, and lock mechanisms 60 to 80 as newly added components.

The rotor 16' is different from the rotor 16'rotor 16 discussed already in that a lock mechanism housing space 51 is formed to surround a root portion of the hollow rotary shaft 17', that a portion of a peripheral wall portion 17'A of the hollow rotary shaft 17' is cut out in the axial direction to form a slit 52, and that a pair of support points of swing motion 53 are provided to project into the slit 52, as illustrated in FIG. 4.

As illustrated in FIGS. 3A and 4, the lock mechanism housing space 51 is an annular space. In other words, the lock mechanism housing space 51 is an annular recessed portion that opens toward the bottom wall portion 12 and that surrounds the hollow rotary shaft 17'. The lock mechanism housing space 51 which is an annular recessed portion is configured to receive a large part of both of an engaged portion 60 as discussed later and an engaging portion 72 of the swing member 70, out of the lock mechanisms 60 to 80.

The pair of support points of swing motion 53 are formed by protrusions unitarily formed respectively with a pair of facing wall portions of the slit 52 to project from the facing wall portions toward each other. The pair of support points of swing motion 53 swingably support the swing member 70 at the swing center of the swing member 70 as discussed later, of the lock mechanisms 60 to 80. The swing member 70 is formed with a pair of recesses (not illustrated), with which the pair of support points of swing motion 53 are fitted. When the swing member 70 is fitted into the slit 52, the hollow rotary shaft 17' is deformed such that the slit 52 is widened in the width direction, or the swing member 70 is deformed to be compressed in the width direction.

The lock mechanisms 60 to 80 include the engaged portion 60, the swing member 70, and the urging member 80 in order to inhibit axial rotation of the rotor 16' and the hollow rotary shaft 17' when the tablet cassette 10' is detached from the base 20 to be in a free state.

The engaged portion 60 is an annular member with an inside diameter that is larger than the outside diameter of the hollow rotary shaft 17', and is spaced from the hollow rotary shaft 17' to surround entirely the circumference of the hollow rotary shaft 17'. The engaged portion 60 is fixed to the upper surface of the bottom wall portion 12 of the lower portion 13 (tablet containing space), or unitarily formed with the bottom wall portion 12, to be substantially entirely received in the lock mechanism housing space 51 discussed above. An inner tooth portion 61 to mesh or engage with the engaging portion 72 of the swing member 70 is formed over the circumference of an inner peripheral portion, for example, of the engaged portion 60. The inner tooth portion 61 is shaped such that a plurality of projections and a plurality of recesses alternately appear in the circumferential direction.

The swing member 70 is supported in the slit 52 discussed above by the support points of swing motion 53 so as to be swingable, and includes the follower portion 71 which is swung near the lower end of the hollow rotary shaft 17', the engaging portion 72 which is provided outside the hollow rotary shaft 17' to be swung near the inner tooth portion 61 of the engaged portion 60, and a portion on which the urging member 80 acts (a portion to which one end of a coil spring, as the urging member 80, is fixed). The engaging portion 72 is formed with at least one projection or at least one recess that is to be engaged with at least one recess or at least one projection that constitutes the inner tooth portion 61 provided on the engaged portion 60.

The follower portion 71 and the engaging portion 72 are provided on different sides of the support points of swing motion 53, and the engaging portion 72 and its root portion are received in the lock mechanism housing space 51. When the follower portion 71 is moved into a bottomed hole 17'*a* of the hollow rotary shaft 17', the engaging portion 72 engages with the inner tooth portion 61 to inhibit axial rotation of the hollow rotary shaft 17' (or the rotor 16'). In contrast, when the follower portion 71 is moved into the slit 52 from the internal space of the hollow rotary shaft 17', the engaging portion 72 is spaced away from the inner tooth portion 61 to allow axial rotation of the hollow rotary shaft 17' (or the rotor 16').

As illustrated in FIG. 3B, the hollow rotary shaft 17' and the drive shaft 24 are shaped and positioned as follows: at the time that the follower portion 71 is moved into the bottomed hole 17'*a* or the internal space of the hollow rotary shaft 17', the distance in the axial direction to the lowest position of the follower portion 71 in the bottomed hole 17'*a* of the hollow rotary shaft 17' that is, the distance to a start position of following motion A, as measured from the opening portion at the lower end of the hollow rotary shaft 17 is larger than the sum (B+C) of an axial length B of the first tapered surface 19' of the bottomed hole 17'*a* of the hollow rotary shaft 17' and an axial length C of the second tapered surface 26 at the distal end of the outer tooth portion 25 of the drive shaft 24.

The follower portion 71 is configured such that the axial position (A) of a portion of the follower portion 71 that is first contacted by the drive shaft 24 when fitting the drive shaft into the hollow rotary shaft 17' is larger than the sum (B+C) of the axial lengths of the first tapered surface 19' and the second tapered surface 26, and is closer to the bottom side (upper side in the drawing) of the bottomed hole 17'*a*.

The urging member 80 (see FIGS. 3A and 8B) is an elastic member such as a coil spring. The urging member 80 is received in the bottomed hole 17'*a* of the hollow rotary shaft 17', and located close to the inner bottom (the upper end portion in the drawing) of the bottomed hole 17'*a*. The urging member 80 is operable to act on a portion of a swingable portion of the swing member 70 that is always received in the bottomed hole 17'*a* to urge the swing member 70 such that the engaging portion 72 of the swing member 70 is moved toward the inner tooth portion 61 of the engaged portion 60 away from the hollow rotary shaft 17'. The swing member 70 is urged such that the follower portion 71 is moved into the bottomed hole 17'*a* of the hollow rotary shaft 17', since the follower portion 71 and the engaging portion 72 are provided on different sides of the support points of swing motion 53 as discussed above.

The use and operation of the tablet cassette 10' according to the first embodiment will be described with reference to the drawings discussed above.

In order to use the tablet cassette 10', the tablet cassette 10' must be replenished with tablets in advance. Thus, the tablet cassette 10' is detached from the base 20 into a free state (see FIGS. 1A, 2A, and 3A). In the free state, the lid 15 is opened to allow an appropriate amount of tablets to be input into the upper portion 14 (tablet containing space), and then the lid 15 is closed to finish the replenishment work. After that, the tablet cassette 10' containing the tablets is moved to a position right above the base 20 (see FIG. 3B). Until then, the tablet cassette 10' is in a free state in which nothing abuts against the follower portion 71 of the swing member 70. While the engaging portion 72 of the swing member 70 is urged by the urging member 80 and is kept engaging with the inner tooth portion 61 of the engaged portion 60, the hollow rotary shaft 17' and the rotor 16' do not make any axial rotation. As a result, the tablets are not discharged from the discharge port of the tablet cassette 10' in an undesirable manner.

When the tablet cassette 10' is moved down toward the base 20 located below, the fitting frame 11 of the tablet cassette 10' is fitted with a fitting portion 23 of the base 20 so that the tablet cassette 10' and the base 20 are generally aligned with each other in the horizontal and transverse directions, and the first tapered surface 19' of the lower-end opening of the bottomed hole 17*a* of the hollow rotary shaft 17' of the tablet cassette 10' and the second tapered surface 26 at the upper end of the outer tooth portion 25 of the drive shaft 24 of the base 20 contact (or are fitted with) each other. Such tapered surfaces are smoothly fitted with each other in a free fitting state in a contacting stage. When the tablet cassette 10' is moved further downward, fitting between the hollow rotary shaft 17' of the tablet cassette 10' and the drive shaft 24 of the base 20 proceeds to a subsequent meshing state, in which the lower portion of the inner tooth portion 18' of the hollow rotary shaft 17' of the tablet cassette 10' and the upper portion of the outer tooth portion 25 of the drive shaft 24 of the base 20 are fitted with each other to establish meshing between the inner tooth portion 18' and the outer tooth portion 25.

At this point, the drive shaft 24 of the base 20 has not reached the follower portion 71 of the swing member 70 of the tablet cassette 10' yet, and axial rotation of the hollow rotary shaft 17' and the rotor 16' is inhibited by the lock mechanisms 60 to 80. Thus, if there is displacement in tooth position between the inner tooth portion 18' of the tablet cassette 10' and the outer tooth portion 25 of the base 20, the drive shaft 24 of the base 20 receives a component of fitting thrust to make axial rotation for half a tooth or less, absorbing the displacement.

Therefore, the tablets are not discharged from the discharge port of the tablet cassette 10' in an undesirable manner even when the tablet cassette 10' is mounted to the base 20.

When the tablet cassette 10' is moved further downward (see FIGS. 1B, 2B, and 3C), the hollow rotary shaft 17' of the tablet cassette 10' and the drive shaft 24 of the base 20 are fitted with each other and the inner tooth portion 18' and the outer tooth portion 25 are meshed deeply with each other, and the drive shaft 24 of the base 20 abuts against the follower portion 71 of the swing member 70 of the tablet cassette 10' to push the follower portion 71. Thus, the swing member 70 is swung in such a direction that the follower portion 71 which has been pushed is moved out of the slit 52 of the hollow rotary shaft 17'. Then, the engaging portion 72 of the swing member 70 is disengaged from the inner tooth portion 61 of the engaged portion 60 in accordance with the swing motion, thereby cancelling the engagement between the engaged portion 60 and the swing member 70.

In this way, now that the lock mechanisms 60 to 80 has finished its role, accompanying the mounting of the tablet cassette 10' to the base 20, the hollow rotary shaft 17' (or the rotary body 16'A of the rotor 16') can make axial rotation together with the drive shaft 24 of the base 20. Therefore, the tablet cassette 10' operates in the same manner as that (10) according to the related art after being mounted to the base 20. That is, each time the base 20 follows the control to activate the motor to rotate the drive shaft 24, the hollow rotary shaft 17' makes axial rotation, thereby accordingly rotating the rotor 16' axially. Thus, the tablets which are aligned are allowed to fall down one by one from the discharge port H of the lower portion 13 of the tablet container.

Other Embodiments

In the embodiment described above, the respective numbers of teeth of the inner tooth portion 18' of the hollow rotary shaft 17' of the tablet cassette 10' and the outer tooth portion 25 of the drive shaft 24 of the base 20 are large. However, the numbers of teeth may be small as long as the numbers correspond to each other (see Patent Document 3, for example).

In the embodiment described above, the hollow rotary shaft 17' and the rotary body 16'A of the rotor 16' are directly coupled to each other. However, the hollow rotary shaft 17' and the rotary body 16'A of the rotor 16' may be separate and operable in conjunction with each other via a coupling structure (see Patent Document 4, for example).

[Modification]

Figure 5A:
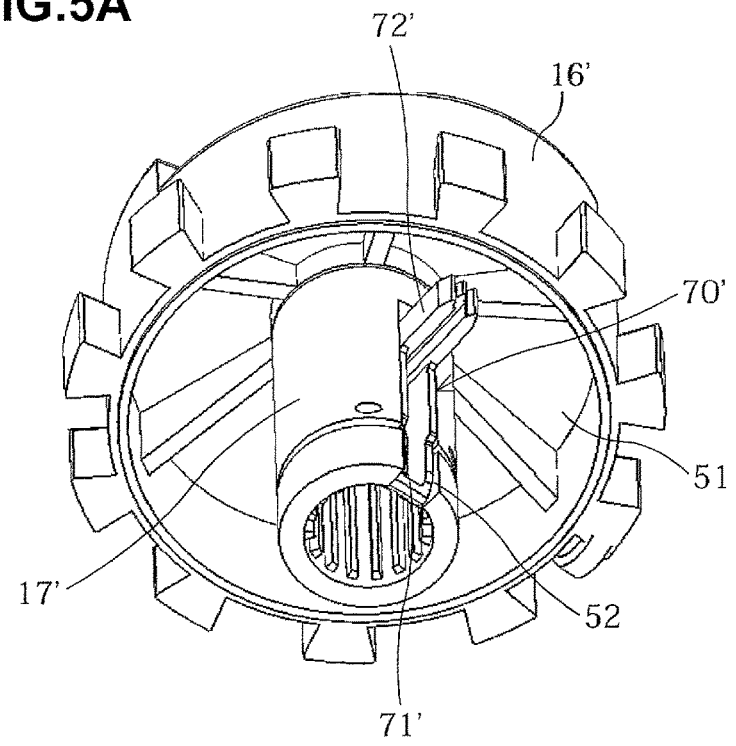
FIGS. 5A and 5B are a perspective view and a bottom view, respectively, of an assembly in which a swing member is assembled into the rotor.
Figure 5B:
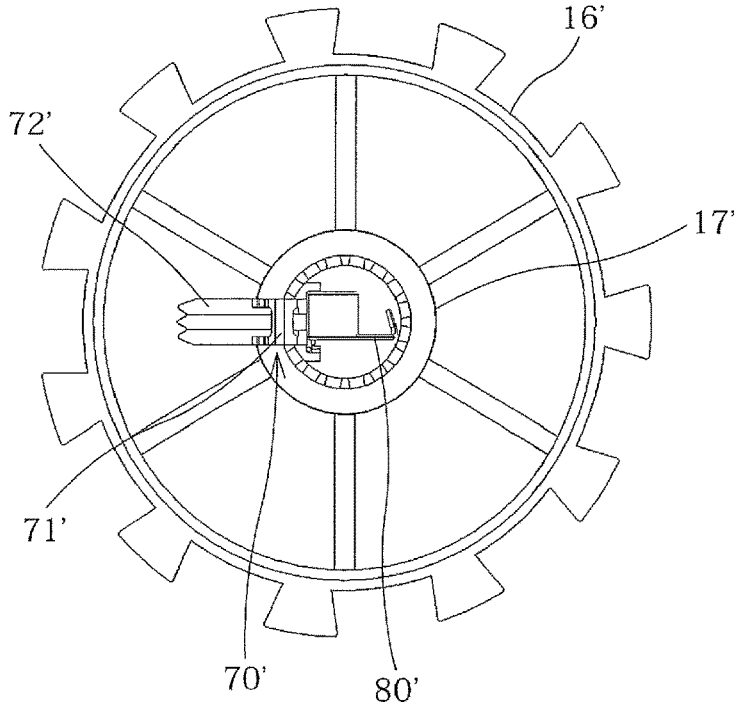
Figure 6A:
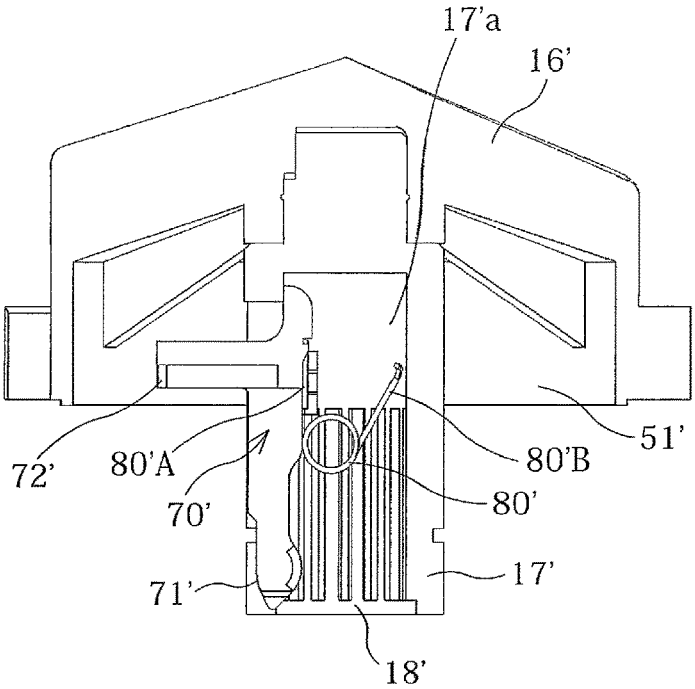
FIG. 6A is a vertical sectional view of the assembly.
Figure 6B:
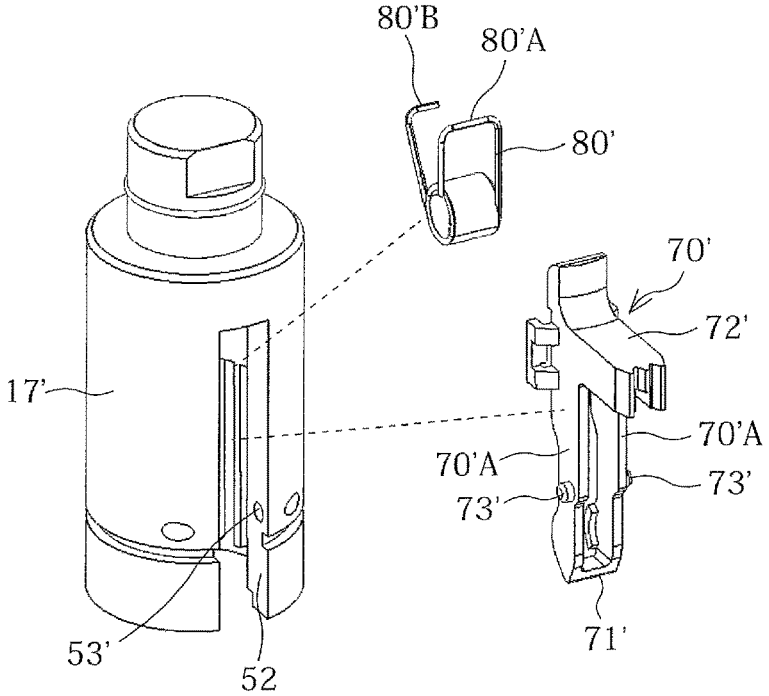
FIG. 6B is an exploded perspective view of the assembly.
Figure 7:
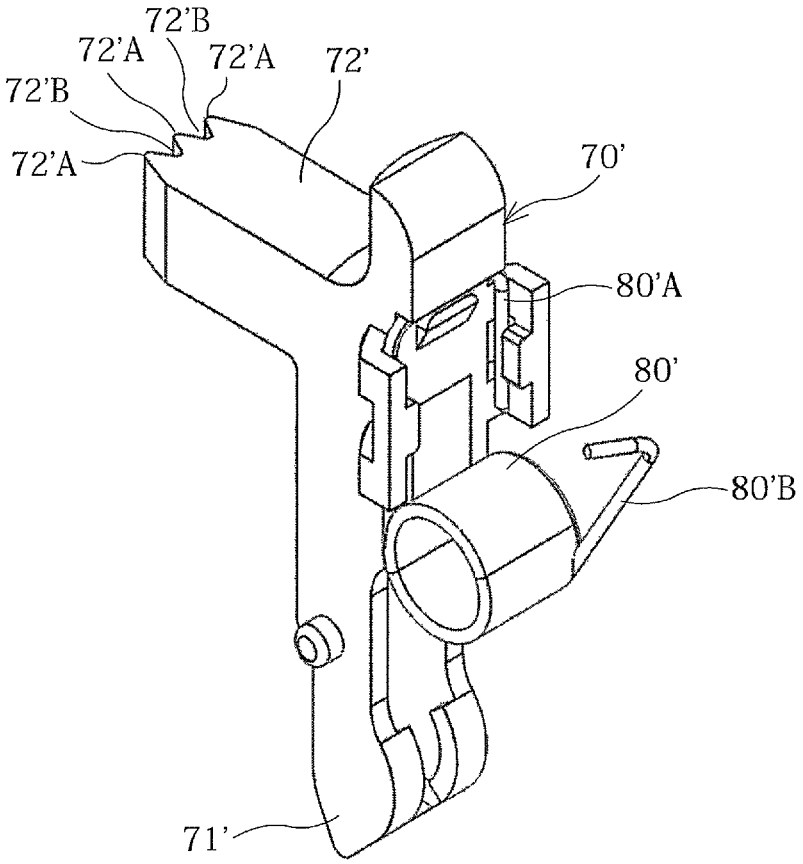
FIG. 7 is a perspective view illustrating that an urging member is combined with the swing member.

A modification of the first embodiment described above will be described with reference to FIGS. 5 to 7. In this modification, the shape of a swing member 70' and the shape of an urging member 80' are different from those of the swing member 70 and the urging member 80 according to the first embodiment. FIGS. 5A and 5B are a perspective view and a bottom view, respectively, of an assembly in which the swing member is assembled into the rotor. FIG. 6A is a vertical sectional view of the assembly. FIG. 6B is an exploded perspective view of the assembly. FIG. 7 is a perspective view in which the urging member is combined with the swing member. In particular, as illustrated in FIG. 6, the body of the swing member 70' includes a pair of plate-like portions 70'A that face each other in the width direction. There is a gap between the pair of plate-like portions 70'A. Therefore, a pair of shaft portions 73' provided on the outer side of the pair of plate-like portions 70'A can be easily fitted with a pair of recesses that constitute support points of swing motion 53' provided in the facing inner wall portions of the slit 52 of the hollow rotary shaft 17' by deforming the pair of plate-like portions 70'A so as to approach each other when fitting the shaft portions 73' with the pair of recesses.

In the present modification, a coil spring of the urging member 80' is disposed in a direction orthogonal to the axis of the hollow rotary shaft 17'. One end 80'A of the urging member 80' is engaged with the swing member 70', and the other end 80'B of the urging member 80' abuts against the inner wall surface of the bottomed hole 17'*a* of the hollow rotary shaft 17'.

Adopting this structure facilitates assembly of the swing member 70' into the hollow rotary shaft 17', and facilitates assembly of the urging member 80' with the swing member 70'.

In addition, an engaging portion 72' of the swing member 70' is formed with three projections 72'A and two recesses 72'B that extend in the axial direction. If the respective numbers of projections 72'A and recesses 72'B are large, the engagement between the engaging portion 72' and the inner tooth portion 61 of the engaged portion 60 can be further secured.

Second Embodiment

Figure 8:
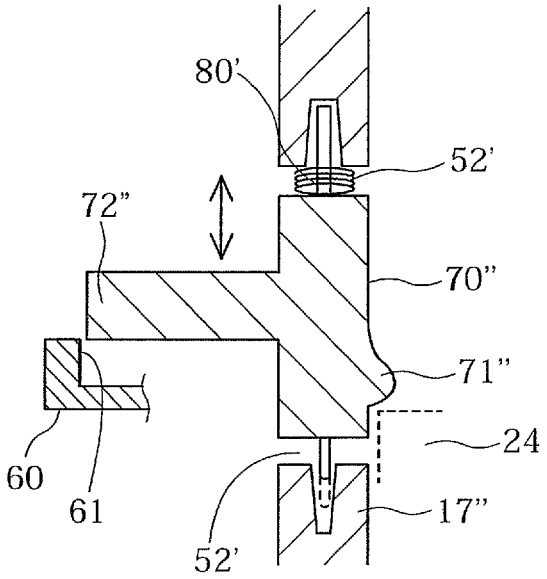
FIG. 8 is a conceptual view illustrating the configuration of a different lock mechanism.

FIG. 8 is a conceptual view illustrating the configuration of another lock mechanism adopted in a second embodiment. In this lock mechanism, a hollow rotary shaft 17" is provided with a linear moving member 70" as a swing member to be combined with a slit 52' configured to penetrate the hollow rotary shaft 17" in the radial direction and extending in the axial direction. The linear moving member 70" is provided in the slit 52' so as to be linearly movable in the slit 52', and includes a follower portion 71" located in the internal space of the hollow rotary shaft and an engaging portion 72" located outside the hollow rotary shaft 17". The engaged portion 60 is provided on the bottom wall portion of the tablet container, and spaced from the hollow rotary shaft 17" to surround the hollow rotary shaft 17". The urging member 80' is a coil spring disposed to urge the linear moving member 70" such that the engaging portion 72" is moved toward the engaged portion 60 and the follower portion 71" is linearly moved toward the bottom wall portion 12.

The linear moving member 70" is moved toward the bottom wall portion 12 by an urging force of the urging member 80' to cause the engaging portion 72" to engage with the engaged portion 60 when the hollow rotary shaft 17" is pulled off from the drive shaft 24. When the hollow rotary shaft 17" is fitted with the drive shaft 24, the follower portion 71" is pushed by the drive shaft 24 to cause the linear moving member 70" to move in the slit away from the bottom wall portion 12, thereby cancelling engagement between the engaging portion 72" and the engaged portion 60.

As a matter of course, the structure of the lock mechanism may be different from the structures according to the first and second embodiments as long as the lock mechanism is configured to inhibit rotation of the hollow rotary shaft when the hollow rotary shaft is pulled off from the drive shaft, and to allow the hollow rotary shaft to rotate together with the drive shaft when the hollow rotary shaft is fitted with the drive shaft.

INDUSTRIAL APPLICABILITY

The tablet cassette according to the present invention is applicable not only to the tablet dispensing apparatuses and the tablet splitting apparatuses discussed already, but also to other medicine dispensers such as bottling apparatuses, as long as such apparatuses include a drive portion for a tablet cassette that can be mounted thereon.

The tablet cassette according to the present invention can be used not only for fully automated medicine dispensers, but also for semi-automatic medicine dispensers etc. operable to process tablets one by one upon each manual operation, for example.

The tablet cassette according to the present invention can be used to contain in a random manner and sequentially discharge not only typical tablets such round tablets, but also capsules etc.

DESCRIPTION OF REFERENCE NUMERALS

10 tablet cassette
11 fitting frame
12 bottom plate portion
13 lower portion (tablet containing space)
14 upper portion (tablet containing space)
15 lid
16 rotor
17 hollow rotary shaft
17" a bottomed hole
18 inner tooth portion
19 first tapered surface
20 base (support portion)
21 motor portion (drive portion)
22 support portion (seat portion)
23 fitting portion (seat portion)
24 drive shaft
25 outer tooth portion
26 second tapered surface
10' tablet cassette
50 rotor (rotor)
51 lock mechanism housing space
52 slit (cutout)
53 support point of swing motion
60 engaged portion
61 inner tooth portion (engaged portion)
70 swing member
71 follower portion
72 engaging portion
80 urging member

The invention claimed is:

1. A tablet cassette comprising:

a tablet container having a tablet containing space therein for containing a plurality of tablets in a random manner, the tablet container including a bottom wall portion formed with a discharge port to allow the plurality of tablets in the tablet containing space to fall down one by one;

a rotor including a hollow rotary shaft having an axial line extending in a direction orthogonal to the bottom wall portion and having an opening portion on an opposite side to the tablet containing space, and a rotary body configured to rotate about the axial line together with the hollow rotary shaft in the tablet containing space of the tablet container and having a plurality of tablet receiving portions provided in a peripheral portion of the rotary body at predetermined intervals in a circumferential direction to receive the tablets one by one and to allow the tablets to pass therethrough to the discharge port, wherein the rotor is rotated when a motor is rotated with a drive shaft operable to be rotated by the motor being fitted with the hollow rotary shaft; and a lock mechanism configured to inhibit rotation of the hollow rotary shaft when the hollow rotary shaft is pulled off from the drive shaft, and to allow the hollow rotary shaft to rotate together with the drive shaft when the hollow rotary shaft is fitted with the drive shaft, wherein:

the lock mechanism includes:

a slit formed in the hollow rotary shaft to penetrate the hollow rotary shaft in a radial direction and extending in an axial direction, a swing member supported with respect to the hollow rotary shaft so as to be swingable about a support point of swing motion provided in the slit, the swing member including a follower portion located in an internal space of the hollow rotary shaft and an engaging portion located outside the hollow rotary shaft, an engaged portion provided on the bottom wall portion of the tablet container and spaced from the hollow rotary shaft to surround the hollow rotary shaft, and an urging member operable to urge the swing member such that the engaging portion is moved toward the engaged portion and the follower portion is moved into the hollow rotary shaft; and the swing member is swung in one direction by an urging force of the urging member to cause the engaging portion to engage with the engaged portion when the hollow rotary shaft is pulled off from the drive shaft, and the follower portion is pushed by the drive shaft radially outward to cause the swing member to swing in the other direction, thereby cancelling engagement between the engaging portion and the engaged portion when the hollow rotary shaft is fitted with the drive shaft.

2. The tablet cassette according to claim 1, wherein:

a plurality of grooves that extend in the axial direction are formed at constant intervals in the circumferential direction in a portion of an inner peripheral portion of the hollow rotary shaft excluding a portion in which the slit is formed; and a plurality of protrusions that extend in the axial direction are provided at constant intervals in the circumferential direction on an outer peripheral portion of the drive shaft to be fitted in the plurality of grooves.

3. The tablet cassette according to claim 1, wherein:

a portion of the rotary body that faces the bottom wall portion is formed with an annular recessed portion that opens toward the bottom wall portion and that surrounds the hollow rotary shaft; and the annular recessed portion receives a part or entirety of the engaged portion and a part or entirety of the engaging portion.

4. The tablet cassette according to claim 1, wherein the urging member is received in the internal space of the hollow rotary shaft.

5. The tablet cassette according to claim 1, wherein:

a first tapered surface is formed at an inner circumferential portion of the opening portion of the hollow rotary shaft;

a second tapered surface is formed at an outer circumferential portion at a distal end of the drive shaft; and a distance between a start position of following motion, at which the follower portion starts following motion, in the internal space of the hollow rotary shaft and the opening portion of the hollow rotary shaft is larger than a sum of an axial length of the first tapered surface of the hollow rotary shaft and an axial length of the second tapered surface of the drive shaft.

6. The tablet cassette according to claim 1, wherein:

the engagement between the engaging portion and the engaged portion is achieved by fitting between at least one projection and at least one recess; and the engaged portion includes a plurality of recesses provided at predetermined intervals in the circumferential direction when the engaging portion includes the at least one projection, and the engaged portion includes a plurality of projections provided at predetermined intervals in the circumferential direction when the engaging portion includes the at least one recess.

7. The tablet cassette according to claim 6, wherein:

the engaged portion has an annular wall surface that extends along the hollow rotary shaft;

the annular wall surface is formed with the plurality of recesses or the plurality of projections that extend along the hollow rotary shaft; and the engaging portion is formed with the at least one projection or the at least one recess that is provided so as not to inhibit swing motion of the swing member.

8. A tablet cassette comprising:

a tablet container having a tablet containing space therein for containing a plurality of tablets in a random manner, the tablet container including a bottom wall portion formed with a discharge port to allow the plurality of tablets in the tablet containing space to fall down one by one;

a rotor including a hollow rotary shaft having an axial line extending in a direction orthogonal to the bottom wall portion and having an opening portion on an opposite side to the tablet containing space, and a rotary body configured to rotate about the axial line together with the hollow rotary shaft in the tablet containing space of the tablet container and having a plurality of tablet receiving portions provided in a peripheral portion of the rotary body at predetermined intervals in a circumferential direction to receive the tablets one by one and to allow the tablets to pass therethrough to the discharge port, wherein the rotor is rotated when a motor is rotated with a drive shaft operable to be rotated by the motor being fitted with the hollow rotary shaft; and a lock mechanism configured to inhibit rotation of the hollow rotary shaft when the hollow rotary shaft is pulled off from the drive shaft, and to allow the hollow rotary shaft to rotate together with the drive shaft when the hollow rotary shaft is fitted with the drive shaft, wherein:

the lock mechanism includes:

a slit formed in the hollow rotary shaft to penetrate the hollow rotary shaft in a radial direction and extending in an axial direction, a linear moving member provided in the slit so as to be linearly movable in the slit, the linear moving member including a follower portion located in an internal space of the hollow rotary shaft and an engaging portion located outside the hollow rotary shaft, an engaged portion provided on the bottom wall portion of the tablet container and spaced from the hollow rotary shaft to surround the hollow rotary shaft, and an urging member operable to urge the linear moving member such that the engaging portion is moved toward the engaged portion and the follower portion is linearly moved toward the bottom wall portion; and the linear moving member is moved toward the bottom wall portion by an urging force of the urging member to cause the engaging portion to engage with the engaged portion when the hollow rotary shaft is pulled off from the drive shaft, and the follower portion is pushed by the drive shaft to cause the linear moving member to move in the slit away from the bottom wall portion, thereby cancelling engagement between the engaging portion and the engaged portion when the hollow rotary shaft is fitted with the drive shaft.

9. The tablet cassette according to claim 8, wherein:

a plurality of grooves that extend in the axial direction are formed at constant intervals in the circumferential direction in a portion of an inner peripheral portion of the hollow rotary shaft excluding a portion in which the slit is formed; and a plurality of protrusions that extend in the axial direction are provided at constant intervals in the circumferential direction on an outer peripheral portion of the drive shaft to be fitted in the plurality of grooves.

10. The tablet cassette according to claim 8, wherein:

a portion of the rotary body that faces the bottom wall portion is formed with an annular recessed portion that opens toward the bottom wall portion and that surrounds the hollow rotary shaft; and the annular recessed portion receives a part or entirety of the engaged portion and a part or entirety of the engaging portion.

* * * * *